US006457185B1

(12) United States Patent
Frazier

(10) Patent No.: US 6,457,185 B1
(45) Date of Patent: Oct. 1, 2002

(54) EASY CONVENIENCE PANTYHOSE

(76) Inventor: Jaynie M. Frazier, 86 Kingsgate #E-103, Lake Oswego, OR (US) 97035

( * ) Notice: Subject to any disclaimer, the term of this patent is extended or adjusted under 35 U.S.C. 154(b) by 0 days.

(21) Appl. No.: 09/858,292

(22) Filed: May 15, 2001

(51) Int. Cl.[7] ..... A41B 9/04; A41B 11/00
(52) U.S. Cl. ..... 2/239; 2/408; 2/409
(58) Field of Search ..... 2/239, 240, 241, 2/242, 409, 408, 407

(56) References Cited

U.S. PATENT DOCUMENTS

| | | | | | |
|---|---|---|---|---|---|
| 676,336 | A | * | 6/1901 | McGuire | |
| 3,362,029 | A | * | 1/1968 | Comerma | 2/240 |
| 3,440,665 | A | * | 4/1969 | Russell | 2/240 |
| 3,486,507 | A | | 12/1969 | Bregenzer et al. | |
| 4,027,667 | A | * | 6/1977 | Swallow et al. | 128/165 |
| 4,301,550 | A | * | 11/1981 | Carver | 2/408 |
| 4,424,596 | A | * | 1/1984 | Jackson | 2/240 |
| 4,807,304 | A | | 2/1989 | McCants-Reed | |
| 5,014,364 | A | | 5/1991 | Orr | |
| 5,027,441 | A | * | 7/1991 | Wilson | 2/240 |
| 5,054,129 | A | | 10/1991 | Baehr | |
| 5,768,713 | A | | 6/1998 | Crick | |
| 5,790,984 | A | * | 8/1998 | Doubleday | 2/69 |
| 5,930,838 | A | * | 8/1999 | Carter-Scott-Pomije | 2/79 |
| 6,101,635 | A | * | 8/2000 | Jones | 2/240 |
| 6,209,143 | B1 | * | 4/2001 | Hancock | 2/406 |

* cited by examiner

*Primary Examiner*—John J. Calvert
*Assistant Examiner*—Alissa L. Hoey
(74) *Attorney, Agent, or Firm*—Ipsolon LLP

(57) ABSTRACT

A pair of pantyhose for aesthetic, medical and athletic purposes having left and right leg portions joined together by a lower torso portion. The lower torso portion includes a relatively large, unobstructed opening between the leg portions. The opening is sized and positioned to expose the wearer's crotch and anus areas when the pantyhose are worn by the wearer. Accordingly, the wearer may perform bodily functions, such as urinating, defecating, and engaging in sexual activities through the opening without having to digitally manipulate any portion of the pantyhose. In a preferred embodiment, the pair of pantyhose is a sheer, pigmented, monolithic, knit or woven, elastic structure. In an alternative preferred embodiment, the torso portion includes an additional resilient element, which thereby allows the pair of pantyhose to function like a pair of control top pantyhose.

20 Claims, 1 Drawing Sheet

EASY CONVENIENCE PANTYHOSE

FIELD OF THE INVENTION

The present invention relates to pantyhose, and more particularly, to pantyhose that contain an unobstructed opening sized and positioned such that a wearer may easily perform bodily functions such as urinate, defecate, and engage in sexual activity there through without at least partially lowering the pantyhose and without undue physical manipulation of any portion of the pantyhose.

BACKGROUND OF THE INVENTION

Pantyhose serve a wide variety of medical, athletic, and aesthetic functions. In one common use, they are constructed of a sheer, pigmented, usually knit or woven, material that serves an aesthetic function to hide blemishes and other imperfections found on the wearer's legs and lower torso. These type of pantyhose, commonly worn by women, can also include elastic material in their leg and torso portions to allow the pantyhose to simultaneously function as a girdle and support hose. These types of pantyhose are commonly referred to as "control top" pantyhose. However, unlike traditional stocking and girdle combinations, control top pantyhose also offer their wearer continuous support along the user's legs and lower torso, thereby eliminating undesirable panty lines and the like.

The amount of support offered by traditional pantyhose can be optimized to thereby allow them to also be used for medical and athletic purposes. For example, doctors often prescribe medical support hose and the like to their male and female patient's with certain medical conditions and following certain types of surgery. These same support benefits also help male and female athletes, such as dancers and the like, perform effectively while reducing risk of injury.

Traditional pantyhose usually require their wearer to pull at least a portion of them down to perform bodily functions such as urinating and defecating. However, patients and physically-challenged individuals wearing such hose often do not have the ability to perform this maneuver without assistance from another person. Moreover, athletes and performers often wear complex uniforms and costumes over their pantyhose, making it difficult to perform this maneuver quickly and easily.

Similarly, when such types of traditional pantyhose are serving a primarily aesthetic function, the pantyhose is usually necessarily constructed of an aesthetically-pleasing, but fragile, woven material. Accordingly, excessive manipulation of this material often results in a premature fray, or "run" in the material, thereby destroying the aesthetic benefits of the pantyhose and rendering them useless. Frequent pulling down and up of pantyhose associated with the wearer performing bodily functions unduly increases the risk of pantyhose runs.

Efforts to provide a pantyhose-type garment that permits its wearer to perform bodily functions without at least partially removing the garment have had limited success. For example, U.S. Pat. No. 5,014,364 to Orr discloses a garment having separate left and fight leg structures that overlap and join together at the wearer's torso forming overlapping flaps adjacent to the wearer's lower torso that must be digitally separated from each other by the wearer to form an opening in the garment that allows the wearer to perform bodily functions there through. Similar overlapping flap-type structures can also be found in U.S. Pat. No. 3,486,504 to Bregnzer et al., U.S. Pat. No. 4,301,550 to Carver, and U.S. Pat. No. 4,807,304 to McCants-Reed.

All of these types of devices require the wearer to manually separate overlapping flaps or the like to expose an opening through which the wearer may perform bodily functions. Able-bodied users of such devices have difficulty simultaneously manipulating these flaps, and sitting on the toilet or the like as described. Moreover, most of these flaps are biased to a closed, or covered position, thereby creating considerable mess should the wearer inadvertently release one or both of the flaps while performing such a bodily function. In addition, these flaps add considerable production costs to the pantyhose manufacture, and they are typically constructed of the same fragile, woven material as the remainder of the pantyhose. Accordingly, repeated manipulation of the flaps increases the likelihood of a run, which can propagate to visible portions of the pantyhose.

III and physically-challenged individuals typically have no easier time manipulating these flaps as described than partially-pulling down a portion of the pantyhose to perform bodily functions. Accordingly, these individuals wearing pantyhose with these types of features, still require assistance to perform such bodily functions.

Another type of known pantyhose has a ventilated crotch area. These type of pantyhose are commonly referred to as "crotchless" pantyhose, and they usually have a small opening aligned adjacent to the vaginal area, or crotch, of the wearer's torso. The primary purpose for these types of pantyhose is to improve ventilation around the wearer's crotch. Some crotchless pantyhose are also aimed at providing erotic aesthetics.

Known crotchless pantyhose offer only a limited benefit in allowing their wearers to perform bodily functions without at least partially removing or otherwise manually-manipulating the garment. For example, in U.S. Pat. No. 5,5054,129 to Baehr, a ventilated crotchless pantyhose garment is disclosed. A small opening is provided adjacent to the wearer's crotch for ventilation and to allow the wearer to urinate without partially removing the pantyhose. However, the opening is so small that "[w]hen stretched on the body it forms a narrow slit which can be digitally manipulated when necessary." Accordingly, such an opening is designed only to allow its wearer to urinate through it, and the wearer, must still digitally manipulate the material surrounding the opening when attempting to urinate through the opening.

SUMMARY OF THE INVENTION

Accordingly, despite the improvements offered by known pantyhose designs, there remains a need for an economical and easy to manufacture pair of pantyhose that when worn, allow its wearer to perform bodily functions such as urinating, defecating and engaging in sexual activity without lowering the pantyhose and without undue physical manipulation of any portion of the pantyhose. In addition to other benefits that will become apparent in the following disclosure, the present invention fulfills these needs.

The present invention is a pair of pantyhose having left and right leg portions joined together by a lower torso portion. The lower torso portion. includes a relatively large, unobstructed opening between the leg portions. The opening is sized and positioned to expose the wearer's crotch and anus areas when the pantyhose are worn by the wearer. Accordingly, the wearer may perform bodily functions, such as urinating, defecating, and engaging in sexual activities without having to digitally manipulate any portion of the pantyhose.

In a preferred embodiment, the pair of pantyhose is a sheer, pigmented, monolithic, knit or woven, elastic structure. In an alternative preferred embodiment, the torso portion includes an additional resilient element, which thereby allows the pair of pantyhose to function like a pair of control top pantyhose. The pantyhose can also be optimized for medical and athletic purposes by constructing the pantyhose with materials having desirable resiliency and support characteristics for such purposes.

DETAILED DESCRIPTION OF PREFERRED EMBODIMENTS

Figure 1:
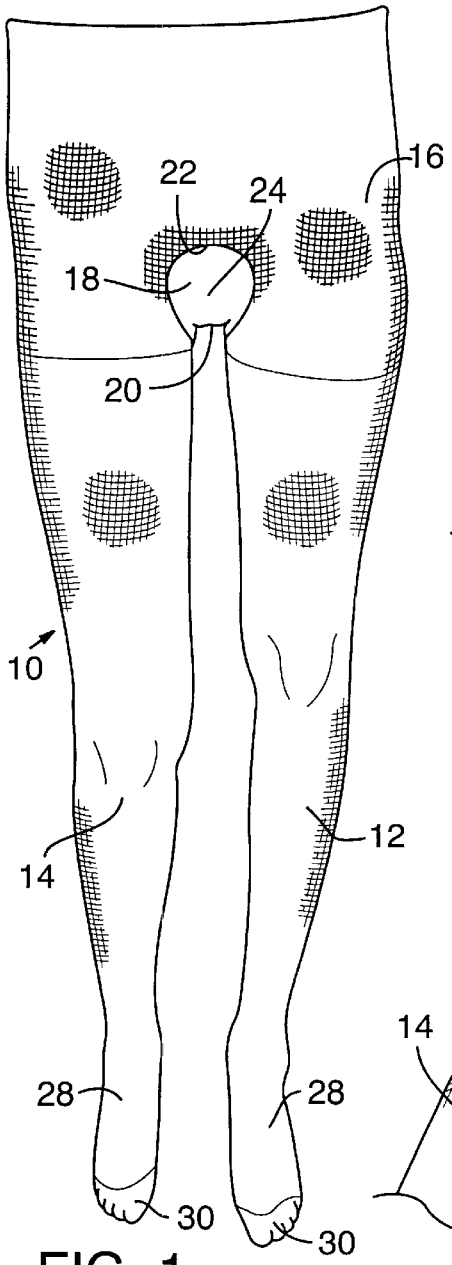
FIG. 1 is an isometric front view of the pantyhose in accordance with a preferred embodiment of the present invention shown being worn on the lower torso and legs of a wearer in a standing position.
Figure 2:
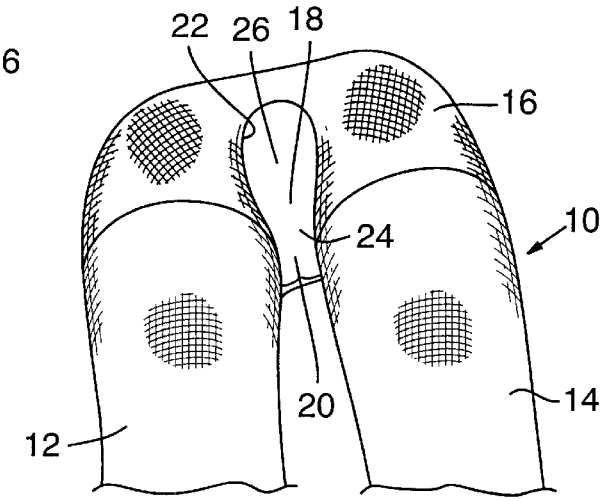
FIG. 2 is a fragmentary, bottom, isometric view of the pair of the pantyhose of FIG. 1 shown on a wearer in a sitting position.
Figure 3:
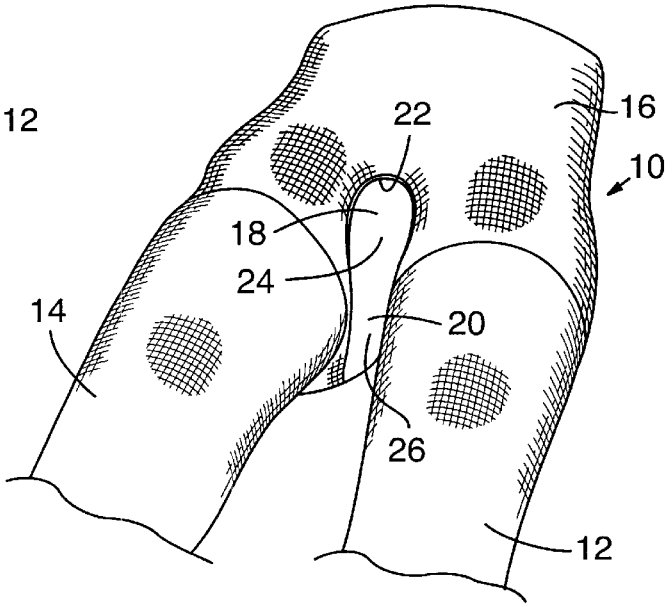
FIG. 3 is a fragmentary, front, isometric view of the pair of pantyhose of FIG. 1 shown on a wearer in a sitting position.

A pair of pantyhose 10 having left leg portion 12 and right leg portion 14 joined at a lower torso portion 16 is disclosed in FIGS. 1–3. The lower torso portion 16 includes a relatively large, unobstructed opening 18 in the crotch area 20 between the leg portions 12, 14, respectively. The opening 18, defined by a substantially arcuate edge 22, is sized and positioned to expose the wearer's crotch 24 and anus 26 when the pantyhose 10 are worn by the wearer.

Preferably, the lower torso portion 16 is preferably sized to fit over a wearer's lower torso, and the left and right leg portions 12, 14 extending therefrom define the crotch area 20 therebetween. The leg portions 12, 14 are preferably conventionally shaped, sized, and styled to receive the wearer's respective left and right legs. The leg portions 12, 14 may include foot portions 28, preferably having reinforced toe sections 30. Alternatively, the foot portions 28 may be open-toed (not shown).

The opening 18 is aligned at the crotch area 20 of the pantyhose 10 as shown such that when a wearer wears the pantyhose 10, his or her anus 26 and crotch 24 are exposed by the opening 18. More preferably, the opening 18 is large enough to provide a large tolerance between the wearer's anus 26 and crotch 20 and the edge 22, thereby preventing inadvertent mess when the wearer performs bodily functions while wearing the pantyhose 10.

In a preferred embodiment, the pair of pantyhose 10 is a monolithic structure that is constructed with conventional materials and methods. In cases where the pantyhose serve a primarily aesthetic function, the pantyhose material is preferably resilient, sheer, and slightly pigmented. One such known preferred material is knit or woven nylon or the like. In such cases, the opening 18 is preferably cut into the pantyhose with the edge 22 finished off in a conventional manner. In an alternative preferred embodiment, the opening 18 is integrally knit or woven therein, thereby preventing uncomfortable seams and the like adjacent to the wearer.

In cases where the pantyhose 10 are used for medical or athletic purposes, they may be constructed with suitable materials and methods having desirable resiliency and support characteristics for such purposes such as lycra, spandex, nylon and the like, and combinations of these materials thereof. Preferably, these materials are integrally knit or woven into a monolithic structure having no seams.

Alternatively, the lower torso portion 16 can include an additional resilient element (not shown) integrally knit or woven therein to allow the torso portion 16 to function like traditional control top pantyhose. If desired, the leg portions 12, 14 can also include a resilient element (not shown) to provide support for the wearer's legs.

The pair of pantyhose 10 of the present invention is worn like traditional pantyhose. The wearer inserts her left and right legs into the respective left and right leg portions 12, 14 of the pantyhose. She then grabs the upper portion of the lower torso portion 16 and slides the pantyhose up her legs until the lower torso portion 16 resides around her lower torso. In this position, the opening 18 is aligned with the wearers' anus 26 and crotch 20 as shown in FIGS. 1–3 such that she may perform bodily functions like urinating and defecating through the opening 18 without soiling the pantyhose 10. Such activities can be performed without any digital or other manipulation of the pantyhose 10.

If desired, the wearer may wear conventional underpants (not shown) or briefs over the pantyhose for modesty or additional comfort purposes. In such case, the wearer must pull down their underpants to perform bodily functions such as urinating and defecating, but need not manipulate the underlying pantyhose 10. Accordingly, risk of premature running of the pantyhose associated with repeated pulling down and up of the pantyhose 10 is avoided.

In view of the wide variety of embodiments to which the principles of the invention can be applied, it should be apparent that the detailed embodiments are illustrative only and should not be taken as limiting the scope of the invention. Rather, the claimed invention includes all such modifications as may come within the scope of the following claims and equivalents thereto.

What is claimed is:

1. A pair of pantyhose to be worn by a wearer having a crotch, anus, abdomen and buttocks, said pantyhose having:

a lower torso portion having a control top that substantially covers the abdomen and buttocks of the wearer;

left and right leg portions extending from said lower torso portion defining a crotch area on said lower torso portion between said left and right leg portions;

an unobstructed opening in the lower torso portion at the crotch area, said opening sized to expose both the crotch and anus of the wearer when worn by the wearer such that the wearer may urinate and defecate through the opening.

2. The pair of pantyhose of claim 1, wherein said pair of pantyhose is a monolithic structure.

3. The pair of pantyhose of claim 2, wherein said pair of pantyhose are constructed with a woven material, and said opening is integrally woven therein defining an edge.

4. The pair of pantyhose of claim 3, wherein said edge is arcuate.

5. The pair of pantyhose of claim 4, wherein said edge is spaced apart from the anus and crotch of the wearer.

6. The pair of pantyhose of claim 1, wherein said pantyhose are constructed with a knit material, and said opening is cut therein defining an edge.

7. The pair of pantyhose of claim 6, wherein said edge is finished to provide a smooth transition between said opening and said pantyhose.

8. The pair of pantyhose of claim 1, wherein said pantyhose are constructed with a knit material, and said opening is integrally knit therein defining an edge.

9. The pair of pantyhose of claim 1, wherein said pair of pantyhose is seamless.

10. The pair of pantyhose of claim 1, wherein said left and right leg portions have foot portions therein.

11. The pair of pantyhose of claim 10, wherein said foot portions have reinforced toe portions thereon.

12. The pair of pantyhose of claim 1, wherein said pantyhose serve a primarily aesthetic function.

13. The pair of pantyhose of claim 1, wherein said pantyhose serve a primarily medical function.

14. The pair of pantyhose of claim 1, wherein said pantyhose serve a primarily athletic function.

15. Integrally knit pantyhose comprising:

a lower torso portion that substantially covers the abdomen and buttocks of the wearer;

left and right leg portions extending from said torso portion defining a crotch area on said lower torso portion between said left and right leg portions;

an unobstructed opening in the lower torso portion at the crotch area defining an edge, said opening sized to expose both the crotch and anus of the wearer.

16. The integrally knit pantyhose of claim 15, wherein said pantyhose is a monolithic structure.

17. The integrally knit pantyhose of claim 16, wherein said edge is arcuate.

18. The integrally knit pantyhose of claim 17, wherein said edge is spaced apart from the anus and crotch of the wearer.

19. The integrally knit pantyhose of claim 18, wherein said pantyhose is seamless.

20. The integrally knit pantyhose of claim 15, wherein the pantyhose are constructed of a sheer, semi-pigmented, resilient material.

* * * * *